US006094881A

United States Patent [19]

Lockwood

[11] Patent Number: 6,094,881

[45] Date of Patent: Aug. 1, 2000

[54] BOX SHAPED STRUCTURAL MEMBER WITH PULTRUDED FLANGES AND CONNECTING WEBS

[75] Inventor: William D. Lockwood, Dayton, Ohio

[73] Assignee: Con/Span Bridge Systems Inc., Dayton, Ohio

[21] Appl. No.: 09/318,457

[22] Filed: May 25, 1999

Related U.S. Application Data

[63] Continuation of application No. 09/070,716, Apr. 30, 1998, abandoned.

[60] Provisional application No. 60/045,498, May 2, 1997.

[51] Int. Cl.[7] ..... E04C 3/30

[52] U.S. Cl. ..... 52/731.2; 52/736.1; 52/731.4; 52/731.3; 52/732.3; 52/737.6; 52/223.8; 29/897.33; 29/897.35

[58] Field of Search ..... 52/731.4, 731.3, 52/731.2, 730.5, 730.4, 726.4, 731.8, 732.1, 732.3, 737.2, 737.6, 730.1, 223.8, 736.1; 29/897.33, 897.35

[56] References Cited

U.S. PATENT DOCUMENTS

| | | | |
|---|---|---|---|
| 608,861 | 8/1898 | Horton | 52/731.3 |
| 742,549 | 10/1903 | Zeh et al. | 52/731.2 |
| 2,181,938 | 12/1939 | Fine . | |
| 2,710,584 | 6/1955 | Ross | 52/737.6 X |
| 3,034,608 | 5/1962 | Dengler . | |
| 3,276,182 | 10/1966 | Handley | 52/732.3 |
| 3,283,464 | 11/1966 | Litzka | 52/731.1 X |
| 3,557,422 | 1/1971 | Pfaff, Jr. | 52/732.3 X |
| 3,727,363 | 4/1973 | Kinsey . | |
| 3,810,337 | 5/1974 | Pollard . | |
| 3,987,593 | 10/1976 | Svensson . | |
| 3,999,354 | 12/1976 | Anter et al. . | |
| 4,248,025 | 2/1981 | Kleine et al. | 52/732.3 |
| 4,580,380 | 4/1986 | Ballard . | |
| 4,580,381 | 4/1986 | Ballard | 52/731.2 X |
| 4,713,924 | 12/1987 | Toti . | |
| 4,843,777 | 7/1989 | Shimabukuro | 52/731.2 X |
| 4,909,011 | 3/1990 | Freeman et al. | 52/732.1 |
| 5,015,119 | 5/1991 | Schmanski . | |
| 5,362,545 | 11/1994 | Tingley | 52/730.1 X |
| 5,476,704 | 12/1995 | Kohler | 428/119 |
| 5,608,999 | 3/1997 | McNamara . | |
| 5,625,996 | 5/1997 | Bechtel | 52/737.6 X |
| 5,653,080 | 8/1997 | Bergeron | 52/730.7 X |
| 5,802,800 | 9/1998 | Meyers | 52/731.2 |

FOREIGN PATENT DOCUMENTS

| | | | |
|---|---|---|---|
| 2308861 | 11/1976 | France . | |
| 2931162A | 2/1981 | Germany . | |
| 4203147 | 7/1992 | Japan | 52/737.6 |
| 692-963 | 10/1979 | U.S.S.R. . | |
| 120991 | 12/1918 | United Kingdom | 52/731.2 |

*Primary Examiner*—Beth A. Aubrey
*Assistant Examiner*—Brian E. Glessner
*Attorney, Agent, or Firm*—Jacox, Meckstroth & Jenkins

[57] ABSTRACT

A tubular structural member, such as a horizontal box beam or vertical column, includes a set of elongated flange members of reinforced pultruded plastics material, and each flange member has longitudinally extending U-shaped opposite edge portions defining slots. Generally flat composite web members have opposite edge portions projecting into the slots, and epoxy adhesive rigidly secures the interfitting edge portions to form a tubular box-beam or multi-sided column. The web members may have curved or tapered opposite edge portions to form a beam with camber or a tapered column having a polygonal cross-sectional configuration. Reinforcing plates or ribs may be adhesively bonded to the flange and/or web members according to the structural loading on the member.

9 Claims, 1 Drawing Sheet

BOX SHAPED STRUCTURAL MEMBER WITH PULTRUDED FLANGES AND CONNECTING WEBS

RELATED APPLICATIONS

This application is a continuation of application Ser. No. 09/070,716, filed Apr. 30, 1998, now abandoned, and claims the benefit of provisional application Ser. No. 60/045,498, filed May 2, 1997.

BACKGROUND OF THE INVENTION

This invention relates to fabricated tubular or box-shaped structural members such as a horizontal beam or a vertical column and of the general type disclosed in U.S. Pat. Nos. 3,999,354 and 4,580,380 which disclose two different forms of fabricated box beams. In the construction of such a structural member, it is not only desirable to provide a member which may be economically constructed and with a high strength/weight ratio, it is also desirable for the construction to provide flexibility so that the member may be conveniently constructed in different sizes and/or shapes according to the structural loading. It is also desirable for the structural member to have moisture and corrosion resistance so that the member has a long service life and requires no significant maintenance.

SUMMARY OF THE INVENTION

The present invention is directed to an improved tubular or box-shaped structural member which provides all of the advantages mentioned above. In the preferred embodiments of the invention, the structural member is constructed entirely of composite materials and includes two or more pultruded elements or flange members each having longitudinally extending non-metallic reinforcement fibers and opposite U-shaped edge portions each defining a groove or slot. Generally flat composite web members have opposite edge portions projecting into the slots of the pultruded flange members, and epoxy adhesive rigidly bonds the opposite edge portions of the pultruded members to the corresponding edge portions of the web panels or members to form a tubular or hollow structural member. The web panels or members may be tapered in a longitudinal direction, for example, to form a tapered tubular column or post, or the web panels or members may be formed with a slight arcuate configuration, for example, to form an elongated beam having a camber. It is also within the scope of the invention to bond reinforcing plates or strips to the pultruded flange members and/or to the web members to provide additional strength to the members.

Other features and advantages of the invention will be apparent from the following description, the accompanying drawing and the appended claims.

DESCRIPTION OF THE PREFERRED EMBODIMENTS

Figure 1:
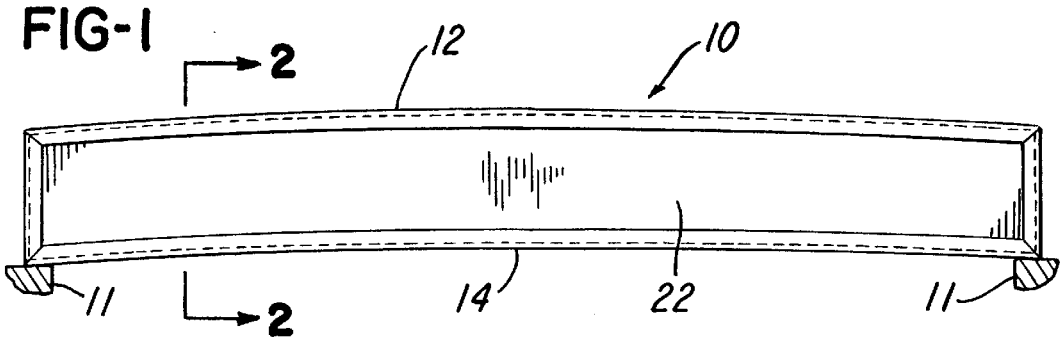
FIG. 1 is a side elevational view of a structural member in the form of a box beam constructed in accordance with the invention.
Figure 2:
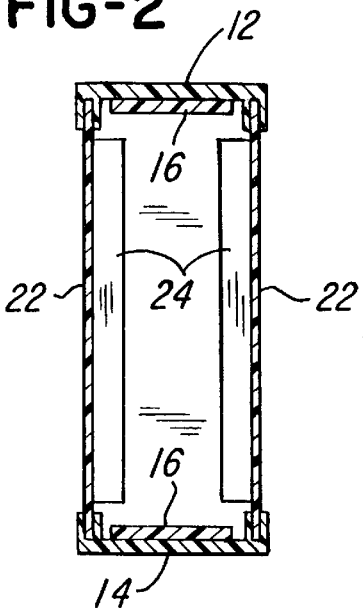
FIG. 2 is a vertical section of the box beam shown in FIG. I and taken generally on the lines 2—2 of FIG. 1.

Referring to FIGS. 1 & 2, a composite box beam 10 has capped end portions supported by supports 11 and includes a top flange member or flange 12 and a bottom flange member or flange 14 each of which is formed as a pultrusion of plastics material and including a base wall integrally connecting two pairs of substantially thinner and parallel spaced flange walls. The flanges include non-metallic reinforcement fibers such as glass or carbon or aramid fibers which provide the desired strength and stiffness properties. The dimensions, thickness and material properties of the flange members may be selected and optimized depending upon the intended use of the structural member. The flange members 12 and 14 may also be reinforced along their length where desired by bonding or adhering reinforcement strips or plates 16 to the inner surfaces of the flanges by suitable adhesive. The reinforcement plates 16 may be of different material such as fiberglass plates to accommodate strength or stiffness requirements.

Figure 3:
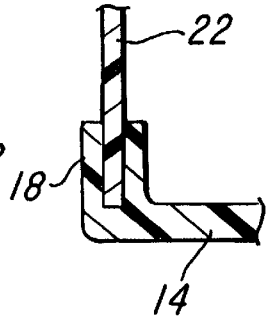
FIG. 3 is an enlarged fragmentary section of a corner portion or joint of the box beam shown on FIG. 2.

Each of the flanges 12 and 14 includes opposite U-shaped or channel-like edge portions 18 (FIG. 3) which receive the upper and lower longitudinally extending edge portions of a pair of generally flat web members 22. The web members 22 are independent fabrications and are illustrated in the form of composite panels of glass reinforced plastics material. The specific material, dimensions and thickness are selected to optimize their function in the structural box beam assembly. The opposite longitudinal edge portions of each web member 22 are secured to the corresponding edge portions 18 of the flanges 12 and 14 by suitable adhesive such as an epoxy adhesive made by Magnolia Plastics, Inc. and sold under the trademark MEGOBOND 56. Longitudinally spaced vertical stiffeners 24 may be bonded by the adhesive to the web members 22 or formed as an integral part of the web members to provide reinforcement or additional stiffness to the web members.

The box-shaped structural member or beam 10 of the invention provides a clean and attractive shape which is adaptable to its application by varying the materials, dimensions and thickness of the flanges 12 and 14 and of the web members 22. The box-shape beam member 10 provides substantial torsional stiffness in order to create a highly stable section. The web members 22 may be tapered or cut to provide for converging flanges for aesthetic or functional variations. A camber, as shown in FIG. 1, may also be formed in the tubular beam 10 by forming slight curves within the web members 22, and stress tendons (not shown) may be added on the inside of the structural member 10 over deviator blocks to provide for a post-tensioned member.

Figure 4:
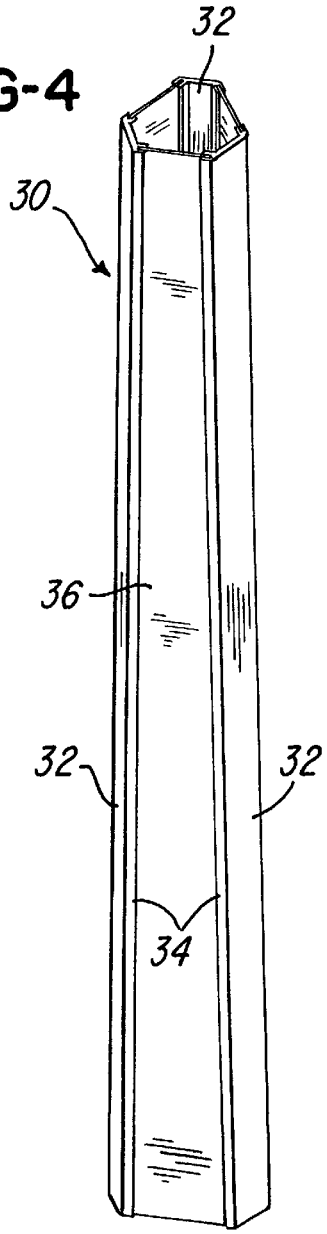
FIG. 4 is a tapered vertical column or post constructed in accordance with another embodiment of the invention.
Figure 5:
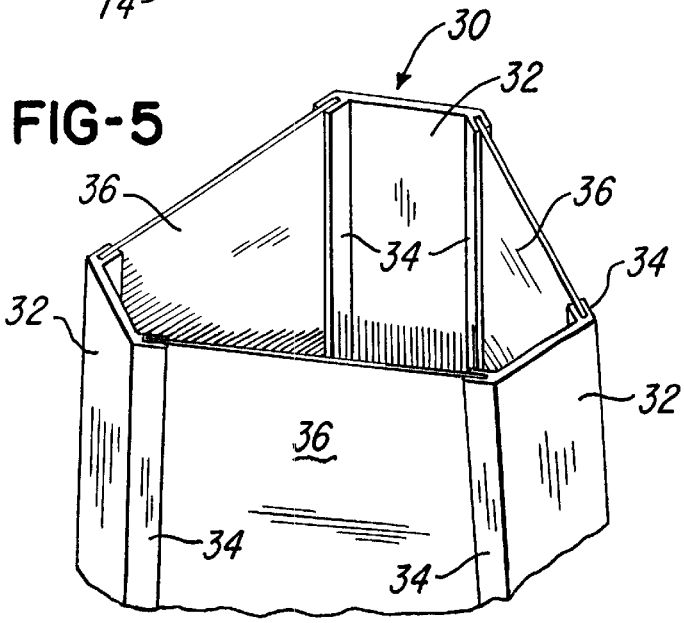
FIG. 5 is an enlarged fragmentary perspective view of the upper end portion of the column or post shown in FIG. 4.

A tubular structural member constructed in accordance with the invention may have other shapes and configurations such as a six or eight sided vertical member for use as a column, pole, tower or pile. For example, referring to FIGS. 4 & 5, a vertical column member 30 includes a set of three pultruded flange members 32 each of which has a uniform cross-section and includes converging opposite U-shaped edge portions 34. The edge portions 34 define converging grooves or slots for receiving the corresponding longitudinal edge portions of generally flat composite web panels 36. The interfitting edge portions of the web members 36 and the edge portions 34 of the flanges 32 are bonded together by a suitable adhesive within the slots, such as the epoxy adhesive mentioned above in connection with FIG. 3. As shown in FIG. 4, the web panels or members 36 may be provided with a slight taper to provide a tapered column 30 which progressively reduces in size towards the top end of the column.

The box-shaped or tubular structural member 10 or 30 provides a structurally efficient shape that can be economically produced with a multitude of materials and dimensional variables. These variables are selected according to the construction application such as applications in the construction of bridges and buildings, transportation applications in truck, bus and train bodies and in various applications in manufacturing.

I claim:

1. A tubular structural member comprising at least two elongated one-piece flange members of fiber reinforced pultruded plastics material, each of said flange members having a channel-shaped cross-sectional configuration formed by a substantially flat base wall of substantially uniform thickness and with said base wall integrally connecting two spaced double wall channel portions projecting from only one side of said base wall, each of said channel portions having two parallel spaced walls defining therebetween a longitudinally extending slot, at least two generally flat elongated composite web members each having fiber reinforcement and a uniform thickness substantially the same as the width of said slots, each of said web members having longitudinally extending opposite edge portions projecting into opposing said slots within two of said channel portions, and an adhesive resin within said slots and bonding said edge portions of said web members to said parallel spaced walls of said channel portions to form a rigid tubular structural member.

2. A structural member as defined in claim 1 and including at least three of said flange members and at least three of said web members, and each of said channel portion members having two of said channel portions with said spaced walls defining converging said slots to form a structural member having a polygonal cross-sectional configuration.

3. A structural member as defined in claim 2 wherein each of said web members has converging said opposite edge portions to provide said tubular structural member with a longitudinally tapered configuration.

4. A structural member as defined in claim 1 and including an elongated substantially flat reinforcing plate adhesively bonded to at least one of said flange members between the corresponding said pairs of said channel portions.

5. A structural member as defined in claim 1 wherein each of said web members has generally slightly curved opposite said edge portions to provide said structural member in the form of a box beam having a camber.

6. A structural member as defined in claim 1 wherein at least one of said web members includes a plurality of longitudinally spaced and rigidly secured reinforcing elements extending between said edge portions of said web member.

7. A structural member comprising two elongated one-piece flange members of fiber reinforced pultruded plastics material, each of said flange members having a channel-shaped cross-sectional configuration formed by a substantially flat base wall of substantially uniform thickness and with said base wall integrally connecting two spaced double wall channel portions projecting from only one side of said base wall, each of said channel portions having two parallel spaced walls defining therebetween a longitudinally extending slot, two generally flat and substantially parallel elongated composite web members each having fiber reinforcement and a uniform thickness substantially the same as the width of said slots, each of said web members having longitudinally extending opposite edge portions projecting into opposing said slots within said channel portions, and an adhesive resin within said slots and bonding said edge portions of said web members to the corresponding said parallel spaced walls of said channel portions to form a rigid tubular box beam.

8. A structural member as defined in claim 7 wherein each of said web members has converging said opposite edge portions to provide said box beam with a longitudinally tapered configuration.

9. A structural member as defined in claim 7 wherein each of said web members has slightly curved said opposite edge portions to provide said box beam with a longitudinal camber.

* * * * *

UNITED STATES PATENT AND TRADEMARK OFFICE

CERTIFICATE OF CORRECTION

PATENT NO. : 6,094,881
DATED : August 1, 2000
INVENTOR(S) : William D. Lockwood

It is certified that error appears in the above-identified patent and that said Letters Patent is hereby corrected as shown below:

Claim 2, line 3, delete "channel portion" and insert -- flange --.

Signed and Sealed this

Fourteenth Day of August, 2001

*Attest:*

Nicholas P. Godici

NICHOLAS P. GODICI
*Acting Director of the United States Patent and Trademark Office*

*Attesting Officer*